United States Patent [19]

Olivieri

[11] 4,268,981

[45] May 26, 1981

[54] ICE SKATING FOOTWEAR

[75] Inventor: Icaro Olivieri, Montebelluna, Italy

[73] Assignee: Icesij A.G., Vaduz, Liechtenstein

[21] Appl. No.: 46,204

[22] Filed: Jun. 7, 1979

[30] Foreign Application Priority Data

Jun. 28, 1978 [CH] Switzerland ..... 7034/78

[51] Int. Cl.[3] ..... A43B 15/16

[52] U.S. Cl. ..... 36/115

[58] Field of Search ..... 36/115, 117, 121, 50

[56] References Cited

U.S. PATENT DOCUMENTS

| | | | |
|---|---|---|---|
| 1,546,551 | 7/1925 | Petri | 36/115 X |
| 1,986,580 | 1/1935 | Johnson | 36/115 X |
| 3,235,978 | 2/1966 | Hyde | 36/115 |
| 3,408,754 | 11/1968 | Kueter | 36/117 |
| 3,939,583 | 2/1976 | Daumann | 36/115 |
| 4,107,856 | 8/1976 | Bourque | 36/115 |

FOREIGN PATENT DOCUMENTS

| | | | |
|---|---|---|---|
| 2749887 | 8/1978 | Fed. Rep. of Germany | 36/115 |

*Primary Examiner*—James Kee Chi

*Attorney, Agent, or Firm*—George E. Kersey

[57] ABSTRACT

Ice skating footwear in which a legging for partially enveloping the leg of a skater above the ankle is pivotally attached at the heel of the footwear. The attachment advantageously is made by lower appendages of the legging which have the appearance of forming a stirrup for the heel. The footwear desirably includes in its sole, a transverse band with lateral portions that partially and adjustably envelope sides of the footwear above the sole.

10 Claims, 3 Drawing Figures

ICE SKATING FOOTWEAR

BACKGROUND OF THE INVENTION

This invention refers to footwear for ice skating, and, more particularly to footwear for ice hockey.

Ice skating footwear must conform structurally to the foot of the skater. It should provide the closest possible anatomical fit without tiring the foot in accordance with the sporting exercise in which the skater is engaged.

In particular, in the case of ice hockey, it is necessary for skating footwear to be structured and dimensioned to withstand the various forces and tortions that one encounters in that kind of sporting exercise. It is common for hockey to involve violent rotations and movements which can have a pronounced local effect. Footwear for ice hockey must be structured accordingly.

For that purpose, footwear for ice hockey generally includes, along with a hull, or body, to which a blade is attached, a legging at the neck of the hull. The legging is usually secured on opposite sides of the hull at about the ankle level of the skater. In accordance with known technology, the legging is connected to the hull by piercing the hull in the neck region, inserting a pivot and clinching the legging and hull to the pivot. To avoid having the extremities of the clinched pivots detract from the overall appearance of the legging, the extremities are usually molded as circular pieces and embedded in the legging.

The hinging of the legging to the neck portion of a shoe used for skating presents technical and economic problems. Besides requiring the use of a trained operator, known procedures limit the productive capacity of the manufacturing facility and increase the cost of producing individual items of footwear.

In addition, the hinge at the neck of the shoe constitutes an undesirable zone where significant pressure is applied during sporting exercises. As a result, there is the possibility of deforming, or even rupturing, the hinge, with consequent danger of damage to the footwear and injury to the skater.

Accordingly, it is an object of the invention to facilitate the realization of suitable leggings for skating, particularly for sportive skating, such as ice hockey. A related object is to alleviate the difficulties and disadvantages associated with known leggings used with footwear for ice skating.

Another object of the invention is to enhance the support provided by leggings used with skating footwear, particularly when used in sporting exercises such as hockey.

Still another object of the invention is to provide for the aesthetic attachment of leggings to skating footwear. A related object is to do so in an economic and advantageous fashion.

A further object of the invention is to provide auxiliary support for ice skating footwear, particularly when used in playing hockey. A related object is to provide for adjustability of the auxiliary support.

SUMMARY OF THE INVENTION

In accomplishing the foregoing and related objects, the invention provides ice skating footwear in which a legging that partially envelopes the leg of a skater above the ankle extends downwardly along opposite sides of a hull to the heel of the footwear. A conventional blade for skating is attachable to the base of the footwear.

In accordance with one aspect of the invention, the legging has downwardly extending appendages that are connected to a transverse member to provide a stirrup-like binding for the heel.

In accordance with another aspect of the invention, a band is provided with a transverse portion affixed to the sole of the footwear near the heel, desirably in a recess, and has lateral portions that partially envelope and are variably securable, to the sides of the hull.

DESCRIPTION OF THE DRAWINGS

Other aspects of the invention will become apparent after considering several illustrative embodiments taken in conjunction with the drawings in which.

DETAILED DESCRIPTION

Figure 1:
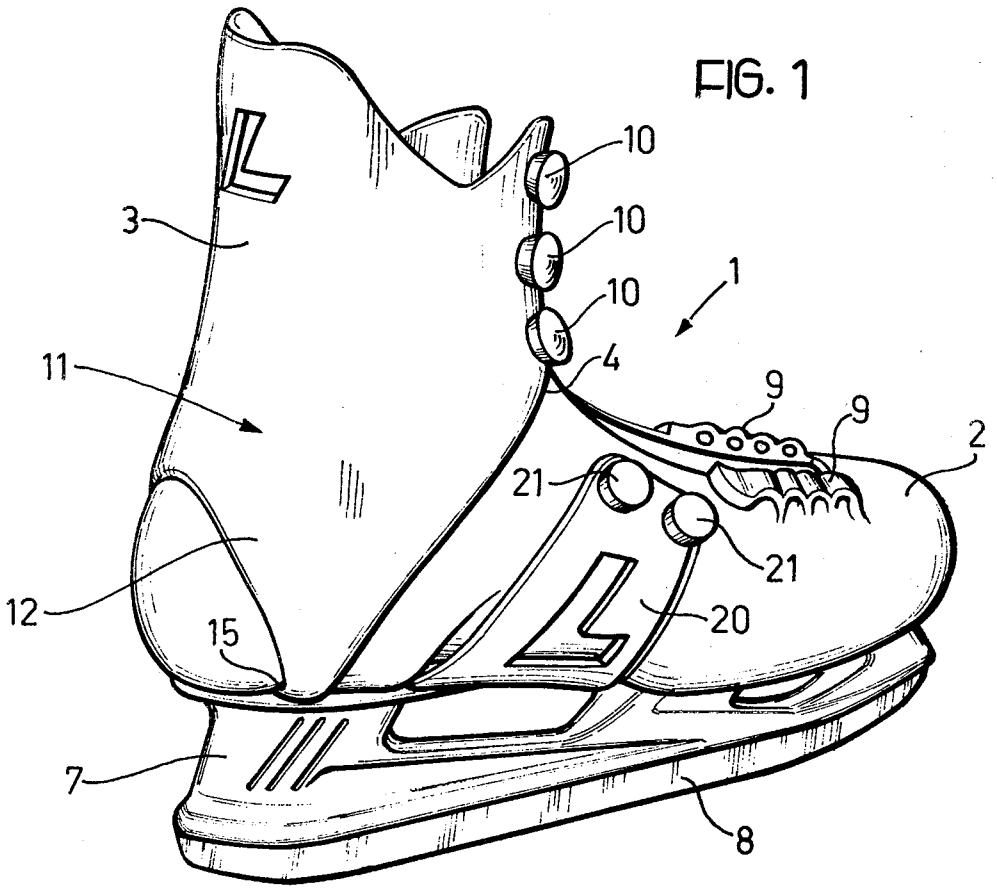
FIG. 1 is a side perspective view of ice skating footwear in accordance with the invention.

Turning to the drawings, footwear for ice skating in accordance with the invention is essentially constituted by a hull or body 2 and a legging 3 that is affixed to the neck 4 of the hull 2. The hull 2 includes a sole 6 with a heel 5 intended to be affixed with known and conventional fasteners to a support 7 to which is affixed a blade 8 for skating (FIG. 1). The hull 2, along with the legging 3, is secured to the leg and foot of the skater in conventional fashion using respective fasteners 9 and 10.

Figure 2:
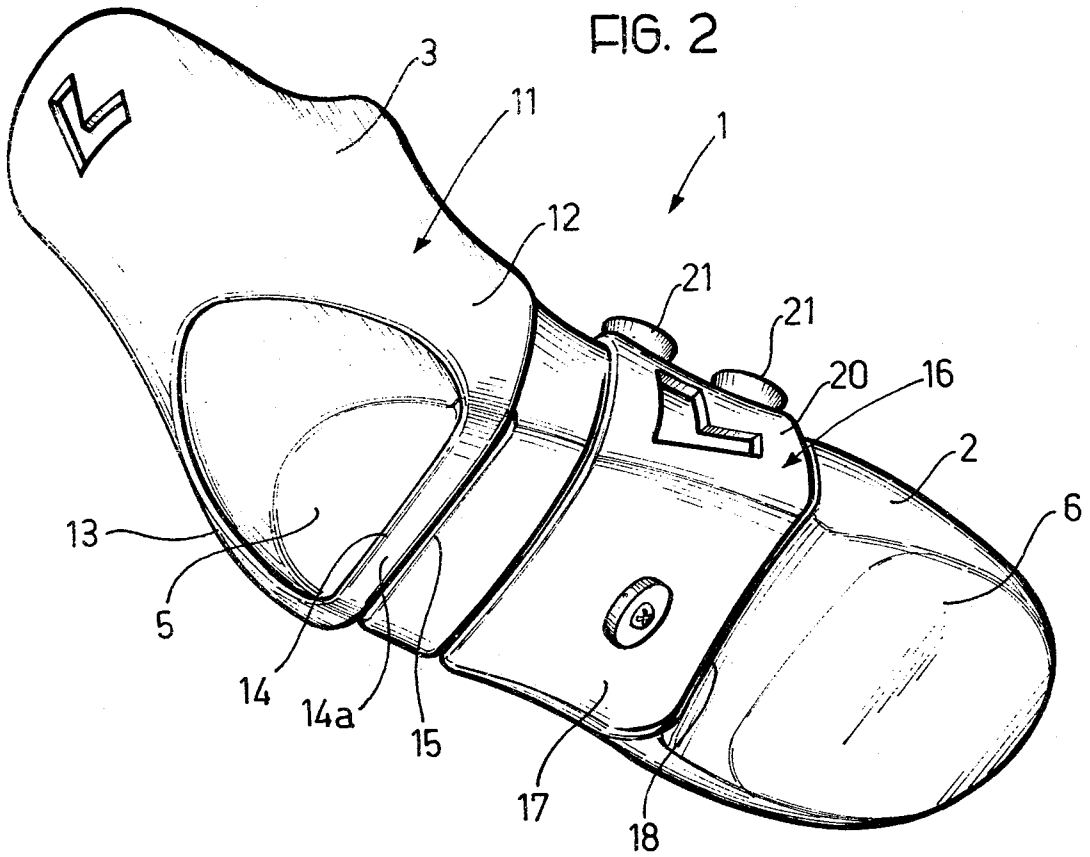
FIG. 2 is a bottom perspective view of the footwear of FIG. 1.
Figure 3:
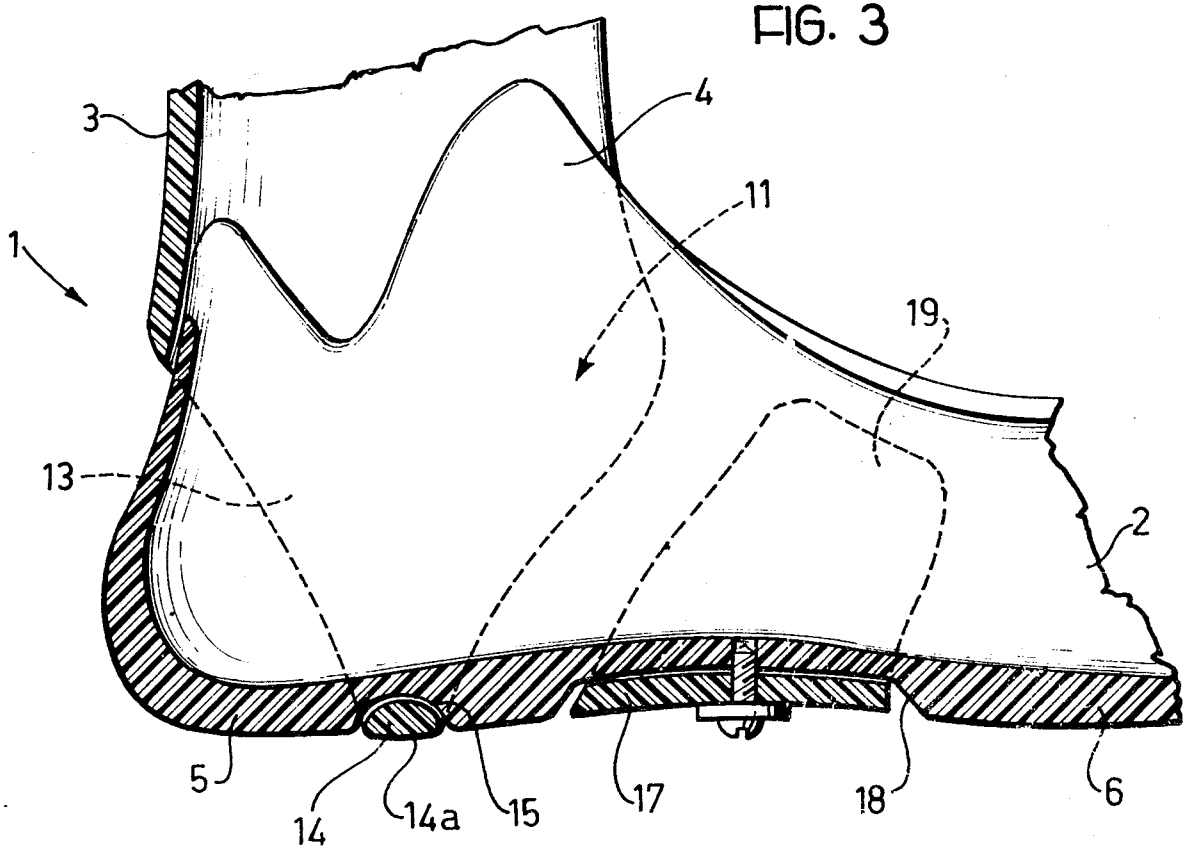
FIG. 3 is a partial cross-sectional view of the footwear of FIG. 1.

The legging 3 extends to a stirrup appendage 11 (FIG. 2) with two portions 12 and 13 which are oppositely positioned on a hull 2 in substantial contact with the neck 4. A third portion 14 extends transversely in a channel 15 of a heel 5 and joins the portions 12 and 13 to complete the stirrup 16. Advantageously the channel 15 is semi-cylindrical and seats a semi-cylindrical portion 14 of the stirrup 11. The channel 15 and the transverse portion 14 are dimensioned to provide a flat portion **14*a* that is essentially coplanar with the heel 5 (FIG. 3**).

The illustrated form of the legging 3 and its connection to the hull 2 provide a rapid, economic and particularly efficacious way of guarding against the forces and tortions exerted against the footwear 1 during a sporting exercise, such as a game of hockey on ice.

The combination of the legging 3 with the hull 2 provides improved adherence of ice skating footwear to the foot of the user.

To further improve the adherence of the footwear, it can be equipped with a band 16 (FIG. 2) having a transverse portion 17 positioned in the hull 2, preferably in a recess 18 transverse 16 formed between the heel 5 and the sole 6 of the hull 2. The band 16 has lateral portions 19 and 20 which partially envelope the hull 2 and are adjustably connected in the manner schematically indicated by attachments 21.

It is to be noted that the band 16 is bound to the hull 2 to allow for the possibility of small angular shifts so as not to interfere with the angular shifts of the legging 3 on the occasion of flexing during, for example, a game of ice hockey.

While various aspects of the invention have been set forth by the drawings and specifications, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. Ice skating footwear comprising a shoe having a neck, a hull, a sole and a heel, and a legging at the neck of the hull, characterized in that the legging extends downwardly on opposite sides of the neck along the sides of the hull in substantial contact therewith and is attached to the heel.

2. Footwear in accordance with claim 1 characterized in that the legging has downwardly extending appendages that are connected to a transverse member to provide a stirrup-like binding for the heel.

3. Footwear in accordance with claim 1 characterized in that the legging is pivoted at the heel.

4. Footwear in accordance with claim 2 characterized in that the pivot is formed by a transverse member at the heel.

5. Footwear in accordance with claim 4 characterized in that the transverse member is disposed in a channel that extends across the heel.

6. Footwear in accordance with claim 5 characterized in that the channel is semi-cylindrical.

7. Footwear in accordance with claim 6 characterized in that the transverse member is semi-cylindrical and has a flat portion aligned with the exterior portion of the heel.

8. Footwear in accordance with claim 1 characterized in that a band with a transverse portion is affixed to the sole near the heel and has lateral portions which partially envelope the hull.

9. Footwear in accordance with claim 8, characterized in that the transverse portion of the band is positioned for rotational movement about a pivot in a recess in the sole.

10. Footwear in accordance with claim 8, characterized in that attachments are provided for temporarily securing the lateral portions of the band to the sides of the hull.

* * * * *